US007578026B2

(12) United States Patent
Lepold et al.

(10) Patent No.: US 7,578,026 B2
(45) Date of Patent: Aug. 25, 2009

(54) VACUUM CLEANER

(75) Inventors: Holger Lepold, Nellmersbach (DE); Alessandro Albanello, Stuttgart (DE); Peter Langer, Schwaikheim (DE); Uli Haeussermann, Fellbach (DE); Roland Jeutter, Berglen (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 595 days.

(21) Appl. No.: 11/323,479

(22) Filed: Dec. 29, 2005

(65) Prior Publication Data

US 2006/0156507 A1 Jul. 20, 2006

Related U.S. Application Data

(63) Continuation of application No. PCT/EP03/13533, filed on Dec. 2, 2003.

(30) Foreign Application Priority Data

Jul. 7, 2003 (DE) ..... 103 30 910

(51) Int. Cl.
*A47L 9/14* (2006.01)

(52) U.S. Cl. ..... 15/347; 15/350

(58) Field of Classification Search ..... 15/347, 15/350, 352, DIG. 8; *A47L 9/14*
See application file for complete search history.

(56) References Cited

U.S. PATENT DOCUMENTS

| | | | |
|---|---|---|---|
| 5,771,529 | A | 6/1998 | Brule et al. |
| 2004/0262911 | A1 | 12/2004 | Bott et al. |

FOREIGN PATENT DOCUMENTS

| | | |
|---|---|---|
| DE | 30 27 913 | 2/1982 |
| DE | 37 14 780 | 12/1988 |
| DE | 40 40 099 | 6/1992 |
| DE | 42 40 913 | 6/1994 |
| DE | 94 19 216 | 2/1995 |
| DE | 101 31 175 | 6/2003 |
| EP | 0 336 914 | 10/1989 |
| EP | 0 677 270 | 10/1995 |
| GB | 1021076 | 2/1966 |

*Primary Examiner*—David A Redding
(74) *Attorney, Agent, or Firm*—Lipsitz & McAllister, LLC

(57) ABSTRACT

The invention relates to a vacuum cleaner with a housing having a dirt chamber closable by a cover, into which a suction socket extends and in which a filter bag is insertable, with a inlet opening of the filter bag being connectable to the suction socket. In order to design the vacuum cleaner so that it allows simple and hygienic handling when removing the filter bag from the dirt chamber it is proposed in accordance with the invention that the suction socket be held on the housing so as to be displaceable back and forth between a position in which it extends into the inlet opening of the filter bag and a position in which it releases the inlet opening.

23 Claims, 4 Drawing Sheets

VACUUM CLEANER

This application is a continuation of international application number PCT/EP2003/013533 filed on Dec. 2, 2003.

The present disclosure relates to the subject matter disclosed in international application number PCT/EP2003/013533 of Dec. 2, 2003 and German application number 103 30 910.1 of Jul. 7, 2003, which are incorporated herein by reference in their entirety and for all purposes.

BACKGROUND OF THE INVENTION

The invention relates to a vacuum cleaner having the features of the preamble of patent claim 1.

Vacuum cleaners with a dirt chamber in which a filter bag is insertable are known, for example, from DE 37 14 780 A1. This publication discloses a vacuum cleaner with a two-part housing. One housing part defining the dirt chamber is articulatedly connected to a further housing part, and between the two housing parts there is arranged an intermediate support on which the suction socket is formed. To remove the filter bag from the dirt chamber it is necessary to first pivot the housing part defining the dirt chamber into a release position, and, subsequently, the intermediate support articulatedly connected to the housing must also be pivoted, so that the suction socket releases the inlet opening of the filter bag.

A vacuum cleaner is known from DE 40 40 099 A1, wherein the suction socket is formed on the housing, and the cover comprises a further socket and a holding device for the filter bag. The filter bag may be attached to the cover in such a way that by placing the cover on the housing, the inlet opening and the further socket are flush with the suction socket, with the suction socket extending into the further socket and the latter, in turn, into the inlet opening.

A vacuum cleaner design is known from DE 30 27 913 A1, wherein the suction socket is secured to the cover, and the suction socket can be transferred to a position extending into the inlet opening of the filter bag by closing the cover.

A vacuum cleaner is known from utility model DE 94 19 216 U1, wherein the suction socket must be separated from the housing in order to be able to insert the filter bag into the dirt chamber. The suction socket may be subsequently connected to the housing, and it then extends into the inlet opening of the filter bag. The filter bag may comprise a closing device for closing the inlet opening. The dirt-filled filter bag can, therefore, be closed before removal from the dirt chamber, so that it is ensured that no dirt can escape when removing it. To do so, it is, however, first necessary to remove the suction socket from the housing.

A vacuum cleaner is known from published European patent application EP 0 677 270 A1, wherein there are formed on the suction socket two diametrically opposed guide pins which are each guided in an axially aligned guide slot. One of the two guide slots extends through a housing wall of the vacuum cleaner and carries at its free end a handle by means of which the user may move the suction socket back and forth in axial direction.

The object of the present invention is to further develop a vacuum cleaner of the kind mentioned at the outset so that it allows simple and hygienic handling when removing the filter bag from the dirt chamber.

SUMMARY OF THE INVENTION

This object is accomplished with a vacuum cleaner of the generic kind, in accordance with the invention, in that the suction socket is coupled by means of a guide mechanism with a pivot lever, and the suction socket is displaceable back and forth by pivoting the pivot lever.

The design according to the invention allows simple handling of the vacuum cleaner when inserting and removing a filter bag. To insert a filter bag, it is merely necessary to move the suction socket into its releasing position. For this purpose, the user can pivot the pivot lever back and forth between a first pivotal position corresponding to the releasing position of the suction socket and a second pivotal position corresponding to the position in which the suction socket extends into the inlet opening, with the pivotal movement of the pivot lever being transferred into a translatory movement of the suction socket by means of the guide mechanism. The filter bag can then be inserted into the dirt chamber. The filter bag may comprise a closing device, and the inlet opening may be released after insertion of the filter bag into the dirt chamber. The suction socket can then be moved into its position in which it extends into the inlet opening of the filter bag by pivoting the pivot lever. If a filter bag filled with dirt is to be removed from the dirt chamber, the suction socket can be moved into its releasing position again by pivoting the pivot lever, so that the filter bag is then readily removable from the dirt chamber, with a particularly hygienic handling being enabled by the inlet opening of the filter bag being closed by the closing device held on the filter bag before it is removed from the dirt chamber.

Particularly easy handling of the vacuum cleaner according to the invention is achievable in a preferred embodiment by a connecting socket being mounted on the housing for connection of a suction hose which is in flow connection with the suction socket via the connecting socket. The connecting socket may be formed on the housing. Alternatively, it may be provided that the connecting socket is releasably connectable to the housing. The connecting socket establishes a flow connection between the suction socket and a suction hose of the vacuum cleaner, with the suction socket being held on the housing so as to be displaceable between its releasing position and its position in which it extends into the inlet opening of the filter bag, while it is not necessary to move the connecting socket and the suction hose held on it relative to the housing in order to exchange the filter bag.

The guide mechanism is expediently formed by a guideway and guide pin connection. The guideway and guide pin connection may comprise a slide guideway in which a guide pin is displaceably mounted, and by generating a relative movement between the slide guideway and the guide pin it is possible to transfer the pivotal movement of the pivot lever into a translatory movement of the suction socket.

The guideway and guide pin connection preferably comprises a rotary sleeve which is coupled with the pivot lever and surrounds the suction socket. The rotary sleeve is held on the housing for rotation about its longitudinal axis and comprises a slide guideway in which a guide pin arranged on the suction socket is displaceably held. By pivoting the pivot lever, the rotary sleeve can be rotated about its longitudinal axis, which results in a relative movement between the slide guideway and the guide pin, so that the suction socket can be displaced together with the guide pin arranged on it.

The pivot lever is preferably formed on the rotary sleeve. This enables particularly cost-effective manufacture.

In order to avoid pressure losses, it is advantageous for a sealing element to be arranged between the rotary sleeve and the suction socket, as air is thereby prevented in a constructionally simple way from flowing through a leak into the suction socket.

It has proven expedient for the sealing element to be configured as a sealing ring, preferably an O-ring, surrounding the suction socket in the circumferential direction.

A particularly trouble-free configuration of the vacuum cleaner is achievable by the sealing element being immovably held on the suction socket. Consequently, the sealing element is displaceable back and forth together with the suction socket.

To prevent the displaceable suction socket from becoming jammed, it is expedient for a guide part to be arranged on the housing and for the end region of the suction socket that faces away from the filter bag to rest slidingly at least in areas thereof against the guide part. Use of the guide part prevents jamming of the suction socket in a constructionally simple way.

It is of advantage for the guide part to be formed on the housing as assembly of the vacuum cleaner can thereby be simplified.

In a preferred embodiment, the guide part comprises a guide sleeve into which the end region of the suction socket facing away from the filter bag extends. It has been found that an extremely low susceptibility to failure of the vacuum cleaner according to the invention is achievable by use of the guide sleeve.

In an advantageous embodiment, a sealing element which prevents air from entering the suction socket through a leak is arranged between the guide sleeve and the suction socket. It may be provided that the sealing element is configured as a sealing ring which can roll on the outer side of the suction socket and the inner side of the guide sleeve. Owing to the rollability of the sealing ring, frictional forces are significantly reduced between the suction socket and the guide sleeve, so that displacement of the suction socket is possible with a very low amount of force and nevertheless air is reliably prevented from flowing in through a leak into the suction socket.

In a particularly preferred embodiment of the vacuum cleaner according to the invention, the guide part comprises a guide socket which extends into the end of the suction socket that faces away from the filter bag. The guide socket forms part of the flow connection between the suction socket and the suction hose which is connectable to the connecting socket, and it is expedient for the guide socket to additionally form a guide for the suction socket. It may, for example, be provided that the suction socket lies slidingly against the outer side of the guide socket.

The guide socket is preferably integrally connected to the guide sleeve. It is particularly advantageous for the guide socket, the guide sleeve and the housing to form a one-piece plastic molded part.

It is expedient for the guide socket and the guide sleeve to define between them an annular space into which the end region of the suction socket facing away from the filter bag extends.

In a particularly preferred embodiment, the pivot lever is located inside the dirt chamber and is coverable by the cover when it is in its pivotal position corresponding to the position in which the suction socket extends into the inlet opening of the filter bag. The pivot lever is, therefore, only accessible to a user after removal of the cover. This enables quasi intuitive operation of the vacuum cleaner as the user will normally remove the cover when a dirt-filled filter bag is to be exchanged. After removal of the cover, the user will recognize the pivot lever which is preferably arranged in the area of the inlet opening of the filter bag and can then readily pivot it so that the suction socket assumes its position in which it releases the inlet opening of the filter bag and in which the filter bag can be removed from the dirt chamber.

It is of particular advantage if the pivot lever blocks placement of the cover on the dirt chamber in its pivotal position corresponding to the position in which the suction socket releases the inlet opening of the filter bag. This reduces the risk that after removal of a filter bag, the user will place the cover on the dirt chamber again without having inserted a new filter bag in the dirt chamber. The risk that the vacuum cleaner will be operated without a filter bag being inserted in the dirt chamber is thereby reduced.

Erroneous placement of the cover on the dirt chamber can be avoided in a constructionally simple way by the free end region of the pivot lever protruding outwards over the dirt chamber when the pivot lever assumes its pivotal position corresponding to the releasing position of the suction socket. In this position, the outwardly protruding pivot lever blocks placement of the cover on the dirt chamber. The user is thereby reminded that before putting the cover on the dirt chamber he should first insert a filter bag into the dirt chamber so as to subsequently move the suction socket into its position in which it extends into the inlet opening of the filter bag by pivoting the pivot lever into the interior of the dirt chamber.

It is particularly advantageous if the pivot lever is automatically lockable in its pivotal position corresponding to the releasing position of the suction socket by removal of the filter bag from the dirt chamber. Consequently, after removal of a filter bag, unintentional pivoting of the pivot lever so as to enable placement of the cover on the dirt chamber is not possible, it first being necessary to unlock the pivot lever.

It may, for example, be provided that the pivot lever is lockable by means of a lock biased elastically into a locking position, with the lock being transferable to an unlocking position against the action of an elastic restoring force by inserting a filter bag into the dirt chamber. The elastically biased lock thus ensures in a constructionally simple way that the pivot lever will be locked upon removing a filter bag from the dirt chamber, and by inserting a filter bag into the dirt chamber, the locking will be automatically released by the lock being transferred to an unlocking position against the action of its elastic restoring force.

It is expedient for the lock to be configured as a leaf spring which cooperates with a detent element of the pivot lever. The detent element may, for example, be configured as a radially outwardly protruding detent projection formed on the pivot lever or on the suction socket.

The following description of a preferred embodiment of the invention serves in conjunction with the drawings to explain the invention in greater detail.

DETAILED DESCRIPTION OF THE INVENTION

Figure 1:
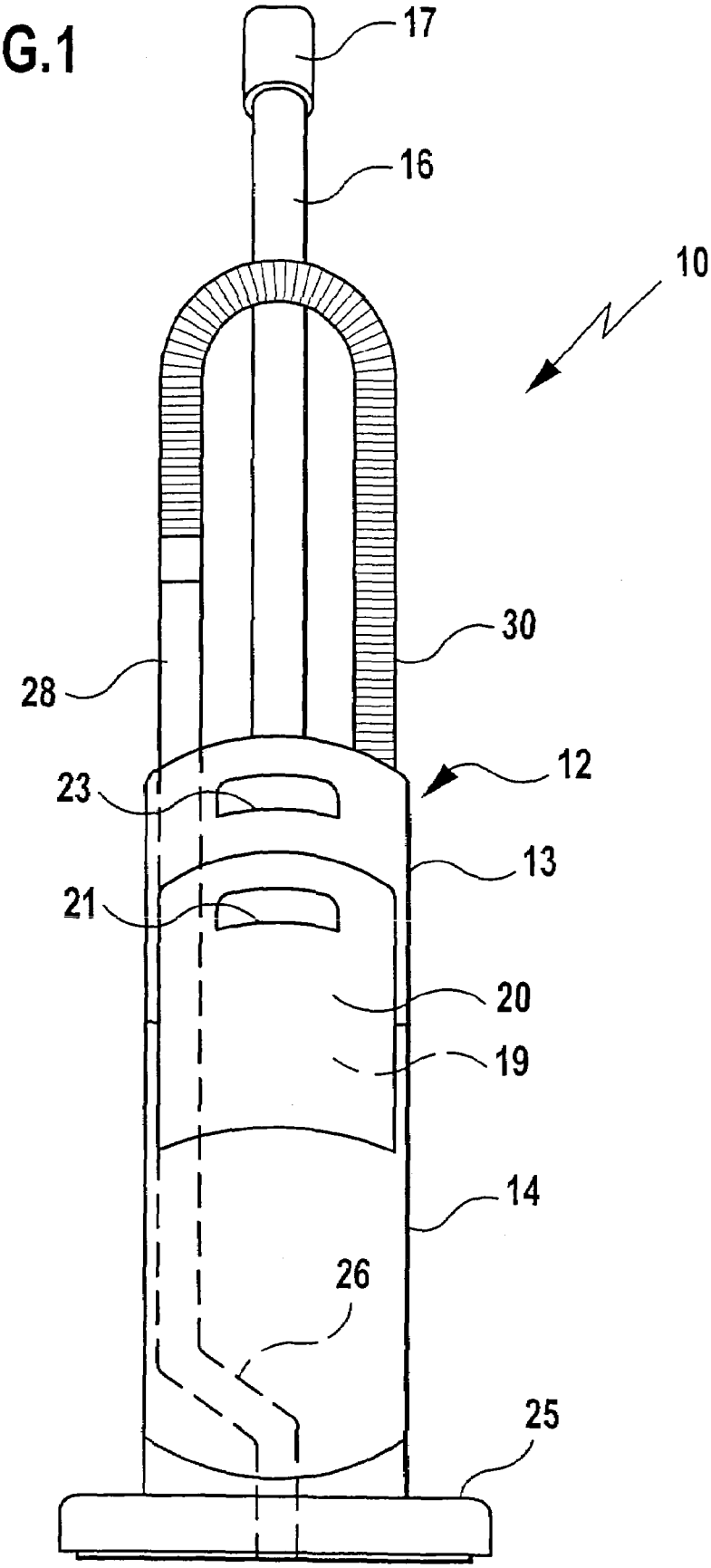
FIG. 1 shows a schematic representation of a vacuum cleaner according to the invention.

The drawings show schematically a vacuum cleaner, generally designated by reference numeral 10, which is designed as a so-called upright vacuum cleaner and comprises a two-part housing 12 with a housing upper part 13 and a housing lower part 14. Adjoining the housing upper part 13 is a shaft 16 carrying a handle 17 at its free end. The housing lower part 14 accommodates in the usual manner, which is, therefore, not shown in the drawings, an electric motor and a suction unit and defines in combination with the housing upper part 13 a dirt chamber 19, which is closable by a cover 20. A recessed grip 21, which facilitates placement and removal of the cover 20 for the user, is formed in the cover 20. A grip handle 23 is formed on the upper side of the housing upper part 13.

The vacuum cleaner 10 comprises a conventional suction nozzle 25, which is known per se and is, therefore, shown only schematically in the drawings, for cleaning a floor surface. Adjoining the suction nozzle 25 in suction flow direction is a suction channel 26, which extends within the housing 12 and is connected to a suction pipe 28 projecting over the housing upper part 13. A suction hose 30 is connected to the free end of the suction pipe 28. The end of the suction hose 30 remote from the suction pipe 28 is in flow connection with a connecting socket 32 held in a releasably connectable manner on the upper side of the housing upper part 13. This is particularly clear from FIG. 2.

Figure 2:
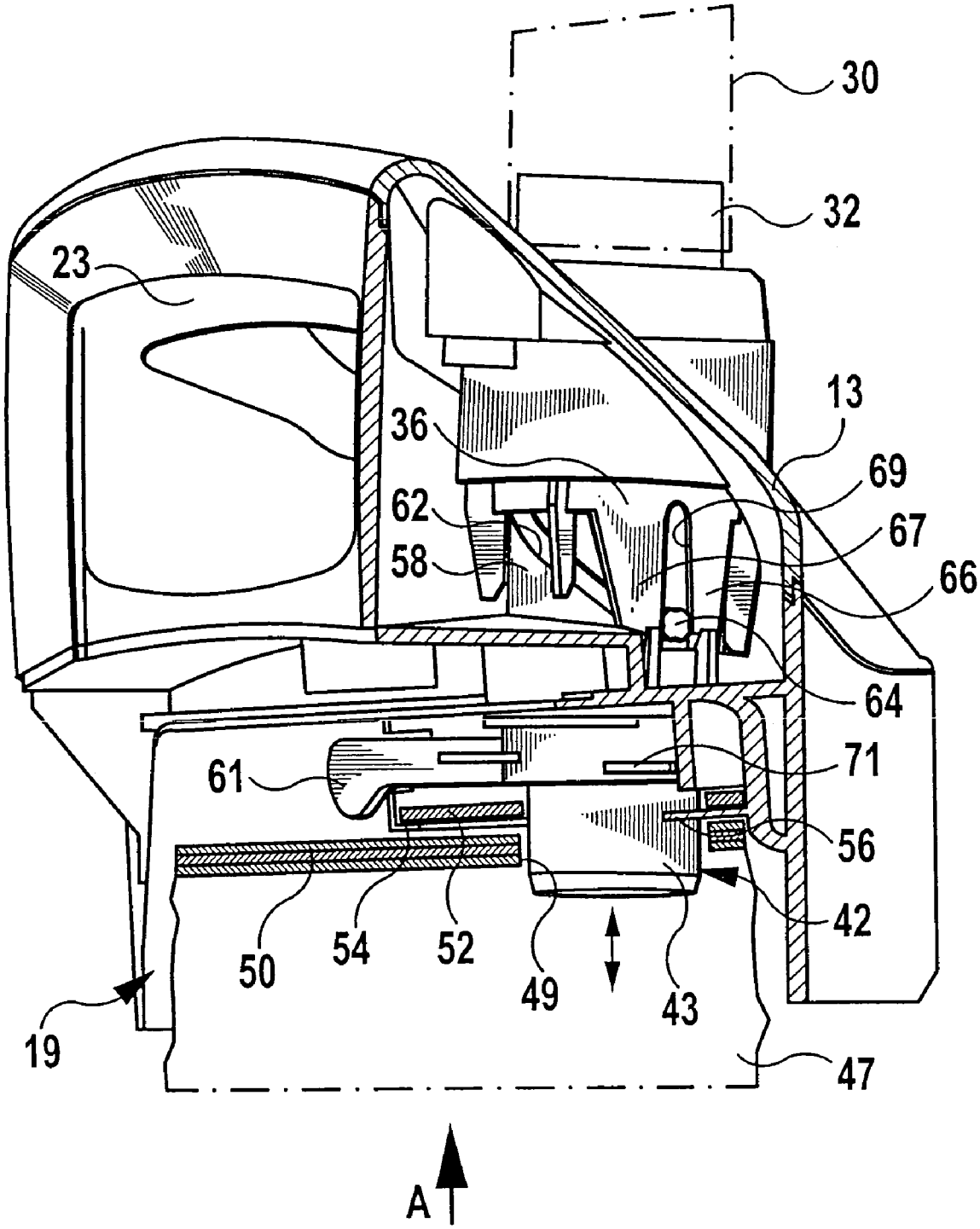
FIG. 2 shows a perspective, partly broken open representation of an upper end portion of the vacuum cleaner from FIG. 1.
Figure 4:
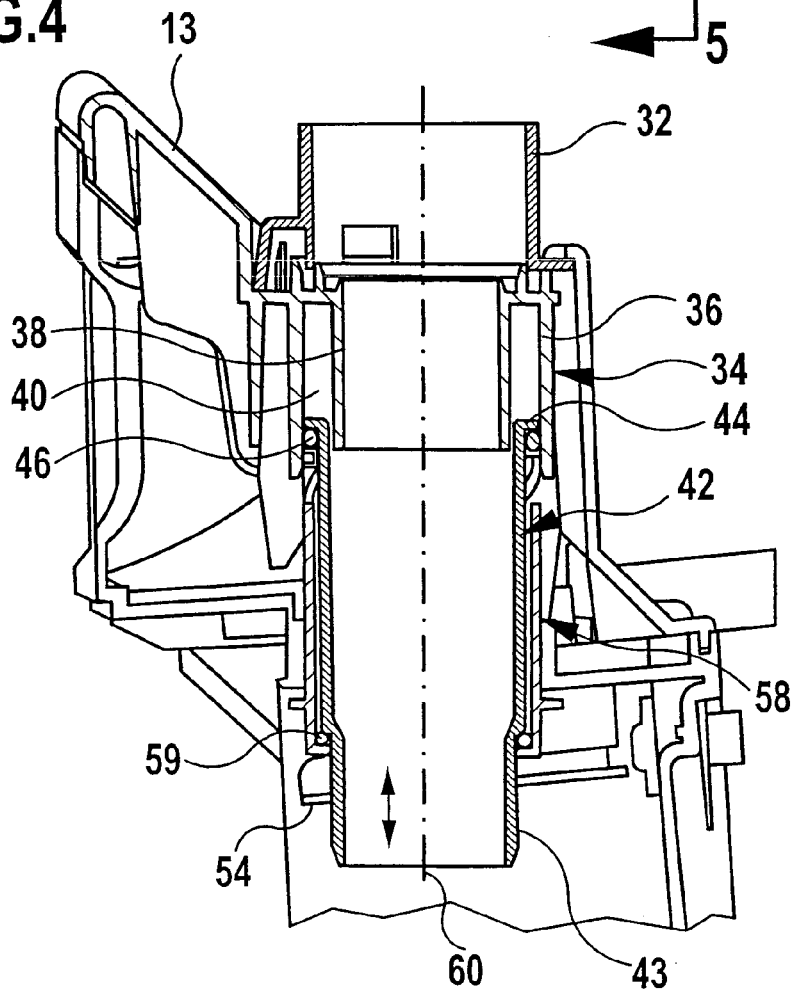
FIG. 4 shows a sectional view of the upper end portion of the vacuum cleaner shown in FIG. 2.

As will be apparent from FIGS. 2 and 4, a guide part 34 is formed on the housing upper part 13 in the area of the connecting socket 32. The guide part 34 comprises a guide sleeve 36 and a guide socket 38 arranged coaxially with and surrounded by the guide sleeve 36, which between them define an annular space 40.

The guide socket 38 extends into a suction socket 42, whose lower end region 43 facing away from the guide socket 38 extends into the dirt chamber 19, while its upper end region 44 facing the guide socket 38 extends into the annular space 40. The upper end region 44 is surrounded by a sealing ring 46 arranged between the suction socket 42 and the guide sleeve 36. When the suction socket 42 is displaced in the direction of the longitudinal axis 60, as will be explained hereinbelow, the sealing ring 46 can roll on both the outer side of the suction socket 42 and the inner side of the guide sleeve 36.

As will be particularly clear from FIG. 2, a filter bag 47, known per se, and, therefore, shown only in dot-and-dash lines in the drawings, may be inserted into the dirt chamber 19. The filter bag 47 comprises a filler opening 49, which may be closed by a closing device 50, known per se, and, therefore, likewise shown only schematically in the drawings. In the area of the filler opening 49, the filter bag 47 carries via holding means, known per se, and, therefore, not shown in the drawings for the sake of better clarity, a holding flange 52. For attachment of the filter bag 47 within the dirt chamber 19, the dirt chamber 19 comprises two holding strips 54, 56 aligned in parallel with each other, which engage under the holding flange 52 of the filter bag 47, so that the filter bag 47 is fixable within the dirt chamber 19.

The dirt chamber 19 may be sucked out in the usual manner by means of the above-mentioned suction unit, i.e., by means of the stream of suction air provided by the suction unit, dirt can be conveyed from the suction nozzle 25 via the suction channel 26, the suction pipe 28 and the suction hose 30 through the suction socket 42 into the filter bag 47.

In its central portion between the lower and upper end regions 43 and 44, the suction socket 42 is surrounded by a rotary sleeve 58, which is aligned coaxially with the suction socket 42 and is mounted in the housing upper part 13 for rotation about the longitudinal axis 60. At is lower end region extending into the dirt chamber 19, the rotary sleeve 58 carries a radially protruding pivot lever 61, and in its upper end region facing the guide part 34, the rotary sleeve 58 comprises two diametrically opposed, helical guide grooves 62, 63.

Extending through each of the guide grooves 62, 63 is a guide pin 64 which is formed on the suction socket 42 and protrudes radially outwardly from the latter. Adjoining each of the guide pins 64 in circumferential direction of the suction socket 42 is a guide lug 66, 67 formed in axial direction on the guide sleeve 36. The guide lugs 66, 67 define between them an axially aligned guide channel 69. The guide channel 69 forms an axially aligned guide for the guide pin 64. Arranged between the suction socket 42 and the rotary sleeve 58 at the level of the lower end region of the rotary sleeve 58 is a sealing ring 59, which is fixed to the outer side of the suction socket 42.

The helical guide groove 62 forms in combination with the guide pin 64 a guideway and guide pin connection. When the pivot lever 61 is pivoted, the rotary sleeve 58 is turned about the longitudinal axis 60, and the guide pin 64 is moved back and forth owing to the relative movement of the guide groove 62 in axial direction, i.e., in the longitudinal direction of the guide channel 69. A pivotal movement of the pivot lever 61 thus results in a translatory displacement of the suction socket 42 in the direction of the longitudinal axis 60.

By pivoting the pivot lever 61 the suction socket can be moved back and forth between a front position in which it extends into the filler opening 49 of the filter bag 47 and a rear position in which it releases the filler opening 49.

Figure 3:
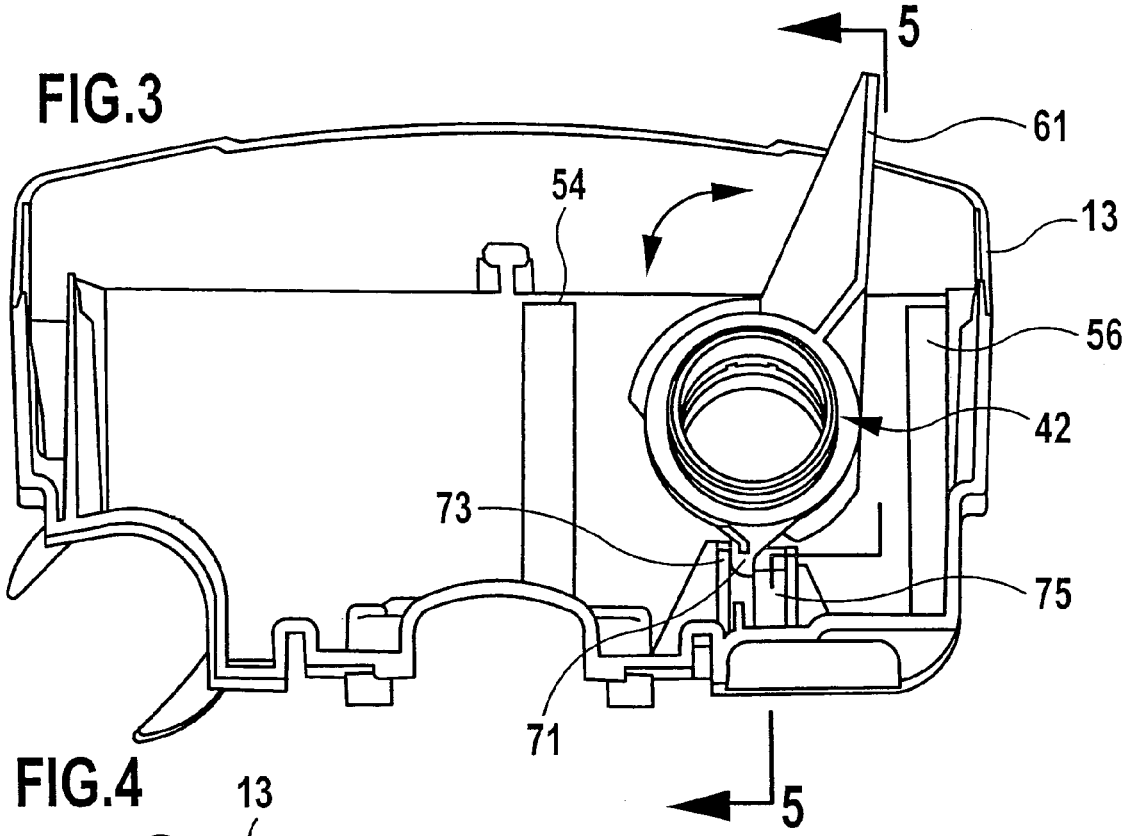
FIG. 3 shows a perspective view in the direction of arrow A from FIG. 2.
Figure 5:
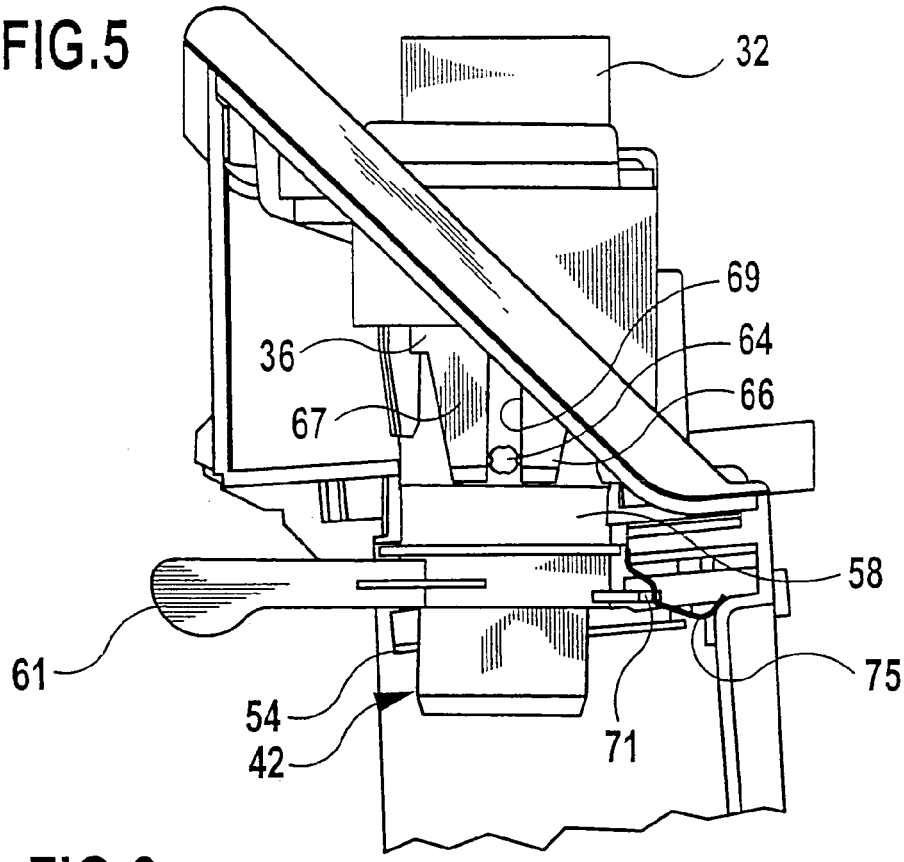
FIG. 5 shows a sectional view along line 5-5 in FIG. 3 prior to insertion of a filter bag.
Figure 6:
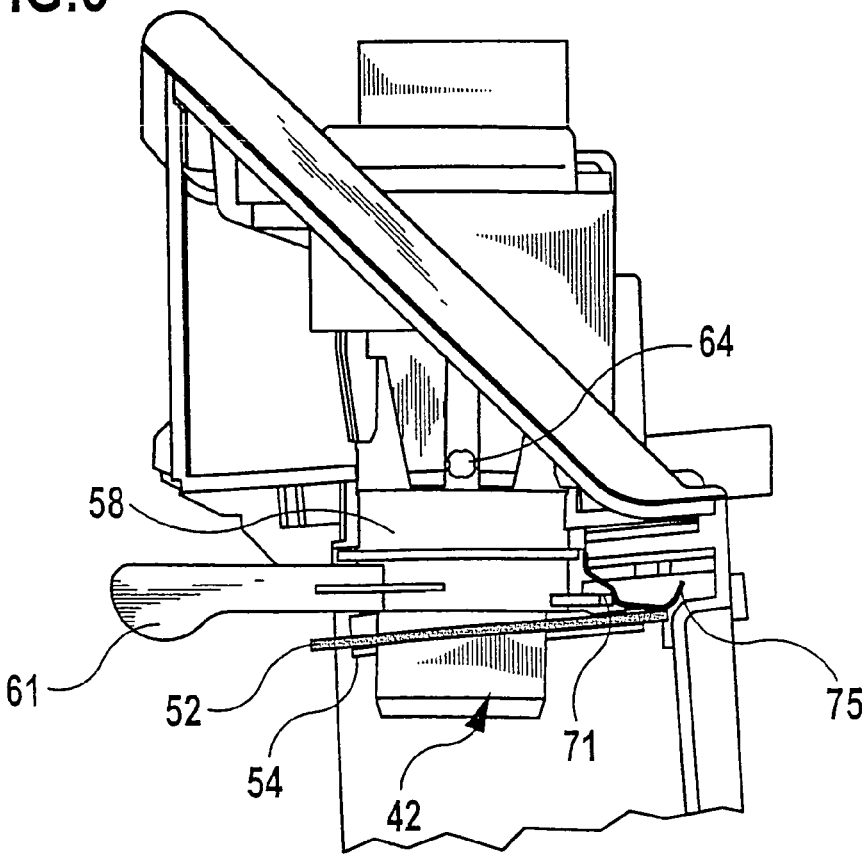
FIG. 6 shows a sectional view corresponding to FIG. 5 after insertion of a filter bag.

As will be apparent, in particular, from FIGS. 3, 5 and 6, a detent projection 71 is formed on the rotary sleeve 58 substantially diametrically opposed to the pivot lever 61. Upon pivoting the pivot lever 61 into the pivotal position corresponding to the releasing position of the suction socket 42, the detent projection 71 can be made to engage a stop 73 which delimits the pivotal movement of the pivot lever 61. Arranged at a distance from the stop 73 inside the dirt chamber 19 is a lock in the form of a leaf spring 75 which is biased in the direction of the lower end region 44 of the suction socket 42. The leaf spring 75 is aligned at an incline to the detent projection 71, so that upon pivoting the pivot lever 61, the leaf spring 75 can be bent back elastically by the detent projection 71 against its elastic restoring force parallel to the longitudinal axis 60 to such an extent that the detent projection 71 can move past the leaf spring 75. The detent projection 71 then comes to rest against the stop 73 and releases the leaf spring 75. If there is no filter bag 47 placed in the dirt chamber 19, the leaf spring 75 assumes a locking position in which the detent projection 71 resting against the stop 73 is locked between the stop 73 and the leaf spring 75. This will be particularly clear from FIG. 3. If the detent projection 71 is to be released, it is necessary to insert a filter bag 47 into the dirt chamber 19, and the holding flange 52, as shown in FIG. 6, transfers the leaf spring 75 against its elastic restoring force to its unlocking position in which the detent projection 71 is able to move past the leaf spring 75. With a view to better clarity, only the holding flange 52 of the filter bag 47 inserted in the dirt chamber 19 is shown in FIG. 6.

From the foregoing it will be clear that the suction socket 42 can be moved back and forth in the direction of the longitudinal axis 60 by pivoting the pivot lever 61. To exchange a filter bag 47, all that is required is to pivot the pivot lever 61 so far in the clockwise direction, based on the view shown in FIG. 3, that the detent projection 71 comes to rest against the stop 73. By pivoting the pivot lever 61, the suction socket 42 can be displaced upwards into its position releasing the filler opening 49 of the filter bag 47. The filter bag 47 is now readily removable from the dirt chamber 19, and the filler opening 49 is optionally closable by the closing device 50, so that the user may remove the filter bag 47 without any risk of dirt escaping from the filter bag 47. When the filter bag 47 is removed from the dirt chamber 19, the holding flange 52 releases the leaf spring 75, so that the latter transfers automatically owing to its elastic restoring force to its locking position in which it locks the detent projection 71 resting against the stop 73 and thus also the pivot lever 61.

As will be particularly clear from FIG. 3, in its locked pivotal position corresponding to the releasing position of the suction socket 42, the pivot lever 61 protrudes outwards over the outer circumference of the dirt chamber 19. Consequently, the cover 20 is unable to be placed on the dirt chamber 19. The dirt chamber 19 can only be closed by the cover 20 after the pivot lever 61 has been pivoted back in the counterclockwise direction, based on FIG. 3, into the interior of the dirt chamber 19. To do so, it is, however, necessary to release the locking of the detent projection 71 by insertion of a new filter bag 47 by the leaf spring 75 being transferred by the holding flange 52 of the filter bag 47 into its unlocking position. After inserting a new filter bag 47, the pivot lever 61 can, therefore, be pivoted back, and the cover 20 can be subsequently placed on the dirt chamber 19, so that the vacuum cleaner 10 can be put into operation again.

The invention claimed is:

1. Vacuum cleaner, comprising:

a housing having a dirt chamber which is closable by a cover, a suction socket extending into the dirt chamber, a filter bag insertable into the dirt chamber, an inlet opening of the filter bag being connectable to the suction socket, and the suction socket being held on the housing so as to be displaceable back and forth between a position in which the suction socket extends into the inlet opening of the filter bag and a position in which the suction socket releases the inlet opening, a pivot lever adapted to be pivoted about a longitudinal axis of the suction socket and coupled to the suction socket via a guide mechanism, wherein the suction socket is displaceable back and forth in an axial direction by pivoting of the pivot lever.

2. Vacuum cleaner in accordance with claim 1, wherein a connecting socket is held on the housing for connecting a suction hose which is in flow connection with the suction socket via the connecting socket.

3. Vacuum cleaner in accordance with claim 2, wherein the connecting socket is releasably connectable to the housing.

4. Vacuum cleaner in accordance with claim 1, wherein the guide mechanism is formed by a guideway and guide pin connection.

5. Vacuum cleaner in accordance with claim 4, wherein:

the guideway and guide pin connection comprises a rotary sleeve which is held on the housing for rotation about the longitudinal axis, the rotary sleeve surrounds the suction socket and is coupled with the pivot lever, and the rotary sleeve comprises a slide guideway with a guide pin arranged on the suction socket and held displaceably in the slide guideway.

6. Vacuum cleaner comprising:

a housing having a dirt chamber which is closable by a cover, a suction socket extending into the dirt chamber, a filter bag insertable into the dirt chamber, an inlet opening of the filter bag being connectable to the suction socket, and the suction socket being held on the housing so as to be displaceable back and forth between a position in which the suction socket extends into the inlet opening of the filter bag and a position in which the suction socket releases the inlet opening, a pivot lever coupled to the suction socket via a guide mechanism, wherein:

the suction socket is displaceable back and forth by pivoting the pivot lever, the guide mechanism is formed by a guideway and guide pin connection, the guideway and guide pin connection comprises a rotary sleeve which is held on the housing for rotation about a longitudinal axis of the rotary sleeve, the rotary sleeve surrounds the suction socket and is coupled with the pivot lever, the rotary sleeve comprises a slide guideway with a guide pin arranged on the suction socket and held displaceably in the slide guideway, and the pivot lever is formed on the rotary sleeve.

7. Vacuum cleaner comprising:

a housing having a dirt chamber which is closable by a cover, a suction socket extending into the dirt chamber, a filter bag insertable into the dirt chamber, an inlet opening of the filter bag being connectable to the suction socket, and the suction socket being held on the housing so as to be displaceable back and forth between a position in which the suction socket extends into the inlet opening of the filter bag and a position in which the suction socket releases the inlet opening, a pivot lever coupled to the suction socket via a guide mechanism, wherein:

the suction socket is displaceable back and forth by pivoting the pivot lever, the guide mechanism is formed by a guideway and guide pin connection, the guideway and guide pin connection comprises a rotary sleeve which is held on the housing for rotation about a longitudinal axis of the rotary sleeve, the rotary sleeve surrounds the suction socket and is coupled with the pivot lever, the rotary sleeve comprises a slide guideway with a guide pin arranged on the suction socket and held displaceably in the slide guideway, and a sealing element is arranged between the rotary sleeve and the suction socket.

8. Vacuum cleaner in accordance with claim 7, wherein the sealing element is configured as a sealing ring surrounding the suction socket in a circumferential direction.

9. Vacuum cleaner in accordance with claim 7, wherein the sealing element is held immovably on the suction socket.

10. Vacuum cleaner comprising:

a housing having a dirt chamber which is closable by a cover, a suction socket extending into the dirt chamber, a filter bag insertable into the dirt chamber, an inlet opening of the filter bag being connectable to the suction socket, and the suction socket being held on the housing so as to be displaceable back and forth between a position in which the suction socket extends into the inlet opening of the filter bag and a position in which the suction socket releases the inlet opening, a pivot lever coupled to the suction socket via a guide mechanism, wherein:

the suction socket is displaceable back and forth by pivoting the pivot lever, a guide part is arranged on the housing, and an end region of the suction socket that faces away from the filter bag rests slidingly at least in areas of the end region against the guide part.

11. Vacuum cleaner in accordance with claim 10, wherein the guide part is formed on the housing.

12. Vacuum cleaner in accordance with claim 10, wherein the guide part comprises a guide sleeve into which the end region of the suction socket that faces away from the filter bag extends.

13. Vacuum cleaner in accordance with claim 12, wherein a sealing element is arranged between the guide sleeve and the suction socket.

14. Vacuum cleaner in accordance with claim 13, wherein the sealing element is configured as a sealing ring which is adapted to roll on an outer side of the suction socket and an inner side of the guide sleeve.

15. Vacuum cleaner in accordance with claim 10, wherein the guide part comprises a guide socket which extends into the end of the suction socket that faces away from the filter bag.

16. Vacuum cleaner in accordance with claim 15, wherein the guide socket is integrally joined to the guide sleeve.

17. Vacuum cleaner in accordance with claim 15, wherein the guide socket and the guide sleeve define between them an annular space into which the end region of the suction socket that faces away from the filter bag extends.

18. Vacuum cleaner comprising:

a housing having a dirt chamber which is closable by a cover, a suction socket extending into the dirt chamber, a filter bag insertable into the dirt chamber, an inlet opening of the filter bag being connectable to the suction socket, and the suction socket being held on the housing so as to be displaceable back and forth between a position in which the suction socket extends into the inlet opening of the filter bag and a position in which the suction socket releases the inlet opening, a pivot lever coupled to the suction socket via a guide mechanism, wherein:

the suction socket is displaceable back and forth by pivoting the pivot lever, in the position in which the suction socket extends into the inlet opening of the filter bag, the pivot lever is located inside the dirt chamber and is able to be covered by the cover.

19. Vacuum cleaner in accordance with claim 18, wherein in the position in which the suction socket releases the inlet opening of the filter bag, the pivot lever blocks placement of the cover on the dirt chamber.

20. Vacuum cleaner in accordance with claim 19, wherein a free end region of the pivot lever protrudes outwards over the dirt chamber when the pivot lever assumes the position in which the suction socket releases the inlet opening of the filter bag.

21. Vacuum cleaner in accordance with claim 19, wherein the pivot lever is automatically lockable in the position in which the suction socket releases the inlet opening of the filter bag by removal of the filter bag from the dirt chamber.

22. Vacuum cleaner in accordance with claim 21, wherein the pivot lever is lockable by means of a lock that is elastically biased into a locking position, and the lock is transferable against an action of an elastic restoring force into an unlocking position by inserting the filter bag into the dirt chamber.

23. Vacuum cleaner in accordance with claim 22, wherein the lock is configured as a leaf spring which cooperates with a detent element of the pivot lever.

* * * * *

UNITED STATES PATENT AND TRADEMARK OFFICE

CERTIFICATE OF CORRECTION

PATENT NO. : 7,578,026 B2
APPLICATION NO. : 11/323479
DATED : August 25, 2009
INVENTOR(S) : Lepold et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 834 days.

Signed and Sealed this

Seventh Day of September, 2010

David J. Kappos

David J. Kappos
*Director of the United States Patent and Trademark Office*